US010101017B2

(12) United States Patent
Toth et al.

(10) Patent No.: US 10,101,017 B2
(45) Date of Patent: Oct. 16, 2018

(54) LED LUMINAIRE WITH INTERNAL HEATSINK

(71) Applicant: GE Lighting Solutions, LLC, East Cleveland, OH (US)

(72) Inventors: Laszlo Toth, Budapest (HU); Peter Almosdi, Budapest (HU); Balazs Nagy, Budapest (HU); Gabor Fejes, Budapest (HU)

(73) Assignee: GE Lighting Solutions, LLC, East Cleveland, OH (US)

( * ) Notice: Subject to any disclaimer, the term of this patent is extended or adjusted under 35 U.S.C. 154(b) by 245 days.

(21) Appl. No.: 14/933,076

(22) Filed: Nov. 5, 2015

(65) Prior Publication Data

US 2016/0223178 A1 Aug. 4, 2016

Related U.S. Application Data

(60) Provisional application No. 62/112,067, filed on Feb. 4, 2015.

(51) Int. Cl.
*F21V 29/70* (2015.01)
*F21V 3/02* (2006.01)
(Continued)

(52) U.S. Cl.
CPC ..... *F21V 29/70* (2015.01); *F21S 8/085* (2013.01); *F21V 3/02* (2013.01); *F21V 19/003* (2013.01);
(Continued)

(58) Field of Classification Search
CPC ..... F21V 29/503; F21V 29/70; F21V 19/003; F21V 23/023; F21V 31/00; F21S 8/05
See application file for complete search history.

(56) References Cited

U.S. PATENT DOCUMENTS 7,637,633 B2 12/2009 Wong
7,674,016 B2 3/2010 Zhang et al.
(Continued)

FOREIGN PATENT DOCUMENTS

CN 101144602 A 3/2008
CN 201344410 Y 11/2009
(Continued)

OTHER PUBLICATIONS

PCT Search Report and Written Opinion issued in connection with corresponding PCT Application No. PCT/US2015/067997 dated Mar. 16, 2016.

*Primary Examiner* — Anabel Ton
(74) *Attorney, Agent, or Firm* — Peter T. DiMauro; GE Global Patent Operation

(57) ABSTRACT

A luminaire includes a housing having an external surface and an internal surface defining an interior volume, with an LED light source mounted on a mounting surface within the interior volume, an internal inter-surface structure within the interior volume in thermal communication with the board and in thermal communication with at least one housing internal surface. The internal inter-surface structure configured to spread heat generated by the LED light source laterally along the internal inter-surface structure. The interior volume of the housing is substantially closed to external air flow. The housing external surface being an about smooth surface free of extruding heat sink fins or ridges, and having a shape sufficient to inhibit the trapping of water or dirt.

18 Claims, 6 Drawing Sheets

(51) Int. Cl.

| | |
|---|---|
| ***F21V 31/00*** | (2006.01) |
| ***F21S 8/08*** | (2006.01) |
| ***F21V 19/00*** | (2006.01) |
| ***F21V 23/02*** | (2006.01) |
| ***F21V 29/503*** | (2015.01) |
| *F21W 131/103* | (2006.01) |
| *F21Y 115/10* | (2016.01) |
| *F21Y 101/00* | (2016.01) |

(52) U.S. Cl.
CPC ..... *F21V 23/023* (2013.01); *F21V 29/503* (2015.01); *F21V 31/00* (2013.01); *F21W 2131/103* (2013.01); *F21Y 2101/00* (2013.01); *F21Y 2115/10* (2016.08)

(56) References Cited

U.S. PATENT DOCUMENTS

| | | | | |
|---|---|---|---|---|
| 7,686,469 | B2 * | 3/2010 | Ruud | F21S 2/005 362/101 |
| D660,495 | S | 5/2012 | Walker et al. | |
| 8,485,691 | B2 | 7/2013 | Hamel et al. | |
| D694,449 | S | 11/2013 | Walker et al. | |
| 8,680,754 | B2 | 3/2014 | Premysler | |
| 8,757,842 | B2 | 6/2014 | Ter-Hovhannisyan | |
| 8,783,917 | B2 * | 7/2014 | Mrakovich | F21V 29/004 362/217.14 |
| 9,121,580 | B1 * | 9/2015 | Bryant | F21V 19/00 |
| 9,163,808 | B1 * | 10/2015 | Lehman | F21V 15/01 |
| 9,383,090 | B2 * | 7/2016 | Scarlata | F21V 29/507 |
| 9,605,821 | B2 * | 3/2017 | Al-Gaadi | H05K 1/0209 |
| 9,752,768 | B2 * | 9/2017 | Roh | F21V 29/76 |
| 2009/0168417 | A1 * | 7/2009 | Zhang | F21S 6/00 362/234 |
| 2009/0213588 | A1 | 8/2009 | Manes | |
| 2009/0303715 | A1 * | 12/2009 | Takasago | F21S 8/086 362/235 |
| 2010/0238671 | A1 | 9/2010 | Catone et al. | |
| 2011/0026251 | A1 * | 2/2011 | Liu | F21V 29/004 362/249.02 |
| 2011/0044043 | A1 * | 2/2011 | Wong | F21V 29/004 362/249.02 |
| 2011/0233568 | A1 | 9/2011 | An et al. | |
| 2012/0262917 | A1 * | 10/2012 | Courcelle | F21V 15/01 362/235 |
| 2014/0049961 | A1 * | 2/2014 | Wilcox | F21V 5/04 362/244 |
| 2014/0254156 | A1 | 9/2014 | Hsu et al. | |
| 2016/0178181 | A1 * | 6/2016 | LaDuca | F21V 19/003 362/296.01 |

FOREIGN PATENT DOCUMENTS

| | | | |
|---|---|---|---|
| CN | 203115720 | U | 8/2013 |
| EP | 2133621 | A2 | 12/2009 |
| FR | 2998032 | A1 | 5/2014 |
| GB | 2494171 | A | 3/2013 |
| JP | 2011216497 | A | 10/2011 |
| KR | 100895516 | B1 | 4/2009 |
| KR | 100924593 | B1 | 10/2009 |
| WO | 2013025252 | A1 | 2/2013 |

* cited by examiner

LED LUMINAIRE WITH INTERNAL HEATSINK

CLAIM OF PRIORITY

This patent application claims the benefit of priority under 35 U.S.C. § 119 of U.S. Provisional Patent Application Ser. No. 62/112,067, filed Feb. 4, 2015, titled "Led Luminaire with Internal Heatsink," the entire disclosure of which is incorporated herein by reference.

BACKGROUND

Light emitting diode (LED) luminaires have proven advantageous over traditional and conventional lighting device by providing comparable illumination level outputs at significantly lower power consumption. LED lighting units are designed for both indoor and outdoor lighting purposes. To increase the overall lumens output, a plurality of LED light engines can be placed into a single luminaire unit and at close proximity to each other. This placement can lead to over-heating of the LED wafers and presents a challenge in maintain a suitable operable temperature.

Conventional LED lamps can include a cylindrical enclosure functioning as a heatsink and a plurality of LEDs mounted on an outer wall of the enclosure. The LEDs are arranged in a plurality of lines along a lateral side of the enclosure and around the enclosure. The enclosure can be open at one end with an air-port, or chimney, so that heat generated by the LEDs is dispersed to external air flow via convection.

In some units, the enclosure can be close-ended with heatsinks mounted (or integrally formed) on an exterior surface to reduce the internal temperature of the enclosure. Using traditional external heatsink fins may compromise the aesthetics of the fixture. These external heatsinks, typically with ridges and/or fins on an external surface, may develop dirt and water deposits that lead to reduction in thermal cooling properties and a commensurate increase in the LED failure rate.

Other conventional attempts to maintain a suitable interior operating temperature include heatsinks internal to the LED housing's enclosure. The fins of these heatsinks do not contact the housing's surface itself, which greatly reduces their thermal cooling performance. The heat radiated by these heatsinks increases the ambient temperature within the housing. To overcome this drawback, the enclosure is made large enough to obtain a sufficient heat dissipating area, making the LED luminaire itself inordinately large, heavy and bulky.

DESCRIPTION

In accordance with embodiments, an internal heatsink structure in an LED Luminaire is capable of dissipating heat from the LED board without the necessity of forming protruding fins on an outer, external, surface of the luminaire. In accordance with embodiments, a finned and/or ribbed structure is in thermal, mechanical connection to an LED light source (LED engine, wafer, lamp, etc.) within the luminaire. This internal structure is in thermal, mechanical connection with an interior surface of the LED luminaire external housing, so that heat generated by the LED light source is transferred to the ambient environment. The internal fins/ribs, spread the heat from the LED board or LED light source (typically comprising concentrated LED heat point sources) to a much greater area on the housing external surface.

In accordance with embodiments, the internal inter-surface structure connecting the LED light source to the external environment can have walls, e.g., interwoven walls formed by about perpendicular intersections between sets of about parallel walls. The walls may define channels to allow heat to spread in a direction parallel to the natural flow of heat from the LED light source when the luminaire is in its normal operating position.

Figure 1:
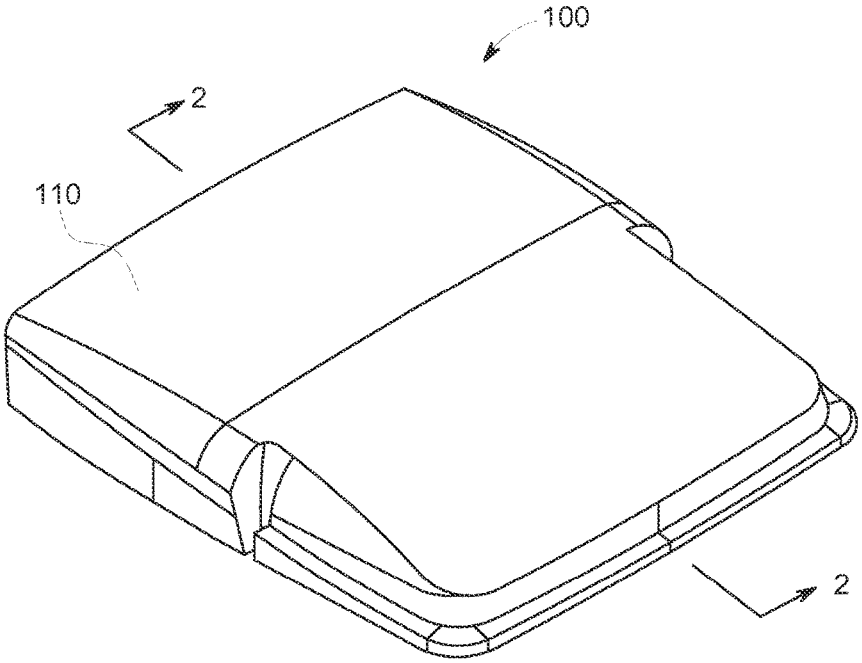
FIG. 1 depicts a top perspective view of an LED luminaire in accordance with some embodiments.

FIG. 1 depicts a top perspective view of LED luminaire 100 in accordance with some embodiments. As depicted in FIG. 1, this implementation has an about smooth external surface 110, that is free of extruding heat sink fins and/or ridges. With an internal inter-surface heat conducting structure, the external surface of the LED housing can be smooth. A smooth outer, external, surface is less prone to allow deposition of water and dirt, which is undesirable both thermally and aesthetically. The weight of the luminaire with an internal heatsink can be comparable to luminaires with a conventional external heatsink.

Embodying implementations can be capable of dissipating heat from the mounting surface carrying the LED light source(s) (e.g., LED wafer, LED light engine, etc.) without the necessity for having any protruding fins on the exterior surface of the luminaire. In some implementations the mounting surface can be a printed circuit board (PCB) made of a glass-reinforced expoxy laminate (e.g., FR4 designation, etc.). In other implementations the LED light source can be a chip-on-board (COB) light source module.

Embodying luminaires employ an arrangement of thermally-conductive walls (i.e., the internal inter-surface structure) interior to the luminaire, with one end (e.g., the top) of such walls being in thermal contact, and/or communication, with an internal, upper part of the housing of the luminaire (e.g., the part which comprises the outer upper portion of the luminaire), and another end (e.g., the bottom) of such walls being in thermal contact (e.g., contacting or touching), and/or communication, with the LED board. This arrangement of walls allows heat to be transferred from the LED board through the internal inter-surface structure to an external surface of the housing, where the heat is dissipated to the ambient environment.

In accordance with implementations, the walls of the internal inter-surface structure may be arranged in a variety of patterns, which may be optimized to facilitate heat transfer. The internal walls may sometimes be alternatively referred to as "fins", but the use of the term "fins" in relation to internal walls, should not be confused with any "fins" which prior art outdoor luminaire may possess on their exterior; the exemplary internal walls or fins disclosed herein, are typically not visible from the exterior of the luminaire, since they are internal to the housing.

Embodiments of the present disclosure typically provide an external surface of an outdoor luminaire which is smooth, or at least, does not comprise any structure that is prone to water and/or dirt deposition. In accordance with some implementations, the external surface of the housing can have dimples, scoops, depressions, and the like for aesthetic considerations. Exemplary luminaires nevertheless are effective in dissipating heat to the environment due to the spread distribution of heat from the LED light source to the housing's external surface achieved by the internal inter-surface structure. This is due to the presence of the internal walls, which may spread heat from the relatively concentrated heat source of the individual LEDs or the LED board, to a much greater area on the outer surface of the housing of the luminaire.

In accordance with implementations, a heat spreader plate can be situated between the LED PCB and the internal walls. This heat spreader plate is of a heat conductive material (e.g., metal, thermally conductive plastic compound, etc.) that spreads the concentrated heat generated by the LED light sources laterally along the heat spreader plate. In accordance with implementations, a thermally conductive paste can be applied to surfaces of the heat spreader plate to aid in the heat transfer from the LED light sources to the walls of the internal inter-surface.

In certain embodiments, the exterior or external upper surface of the housing of the luminaire may comprise a pattern, such as a series of troughs or trenches which may give a ribbed appearance. However, even in the presence of such a pattern on an exterior external upper surface of the housing, the deposition of dirt is inhibited since the pattern is relatively smooth, with few or no sharp angles to trap dirt. Thus, the term "smooth" as used in the present disclosure does not mean that there are no bumps or troughs on the exterior of the housing; rather it refers to any shape of the exterior surface that is sufficiently smooth to inhibit the trapping of dirt.

In accordance with embodiments of this disclosure, the internal walls thermally connect the exterior surface of the luminaire with the light engine mounted on the LED board. Additionally, the internal walls may be capable of spreading heat to exterior portions of the surface of the luminaire where ambient air flow is the greatest. Optionally, the end of the interior walls which is in thermal contact with the LED board may be physically contacted with a heat-spreader—e.g., a slab of metal or other thermally-conductive material physically interposed between the plurality of internal walls and the LED board.

The disclosed smooth exterior surface of the luminaire is less prone to allow deposition of water and dirt, which is undesirable thermally and aesthetically. Owing to the channels that are formed between the internal walls, the weight of the luminaire can be reduced relative to a conventional internal heatsink arrangement that merely comprises a solid block of heat-conductive material (e.g., metal). The interior walls of the present disclosure are in thermal contact with both the exterior surface of the luminaire, and with the LED board, thus enhancing the cooling performance relative to internal fins that do not contact an exterior surface of the luminaire.

Figure 2:
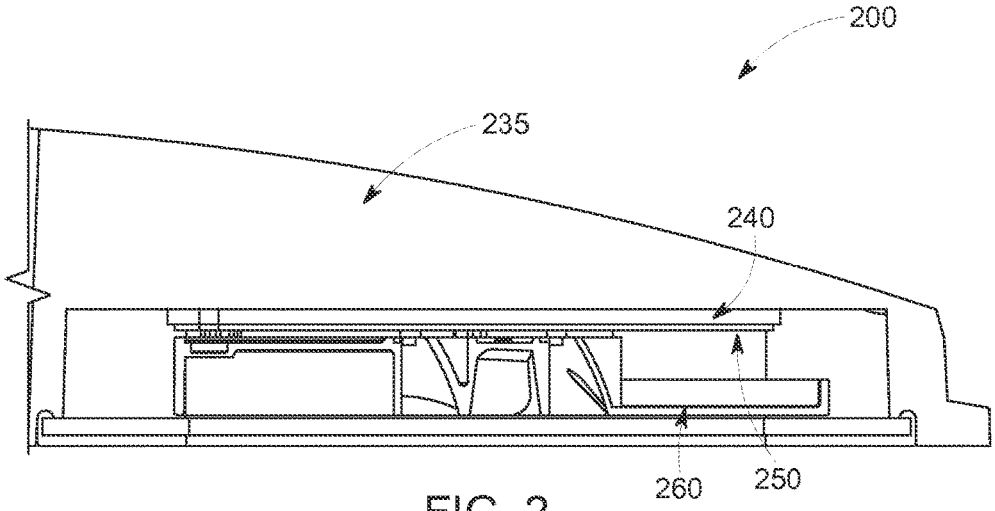
FIG. 2 depicts a cross sectional view of the LED luminaire of FIG. 1 along line 2-2 in accordance with some embodiments.

FIG. 2 depicts a cross sectional view of the LED luminaire of FIG. 1 along line 2-2 in accordance with some embodiments. The LED light source includes mounting board, PCB 250, which can be a metal-core printed circuit board (MCPCB), or the like. On one side of the mounting board, is mounted the LED engine, typically one or more light emitting diode(s). Light generated by the LED engine passes through optical element 260 (reflector, diffuser, cover, etc.) before leaving the luminaire. On another side of the MCPCB is heat spreader plate 240 in thermal and/or mechanical contact with the MCPCB.

This heat spreader plate is in thermal contact with one side of internal inter-surface structure 235. The heat spreader plate and the internal inter-surface structure can be made from metal or a thermally conductive polymer. In some implementations, the material can have a thermal conductivity greater or equal to about 50 Watts per meter Kelvin (W/mK). The internal inter-surface structure can be produced by die-casting, sandcasting, injection molding, etc.

Figure 3A:
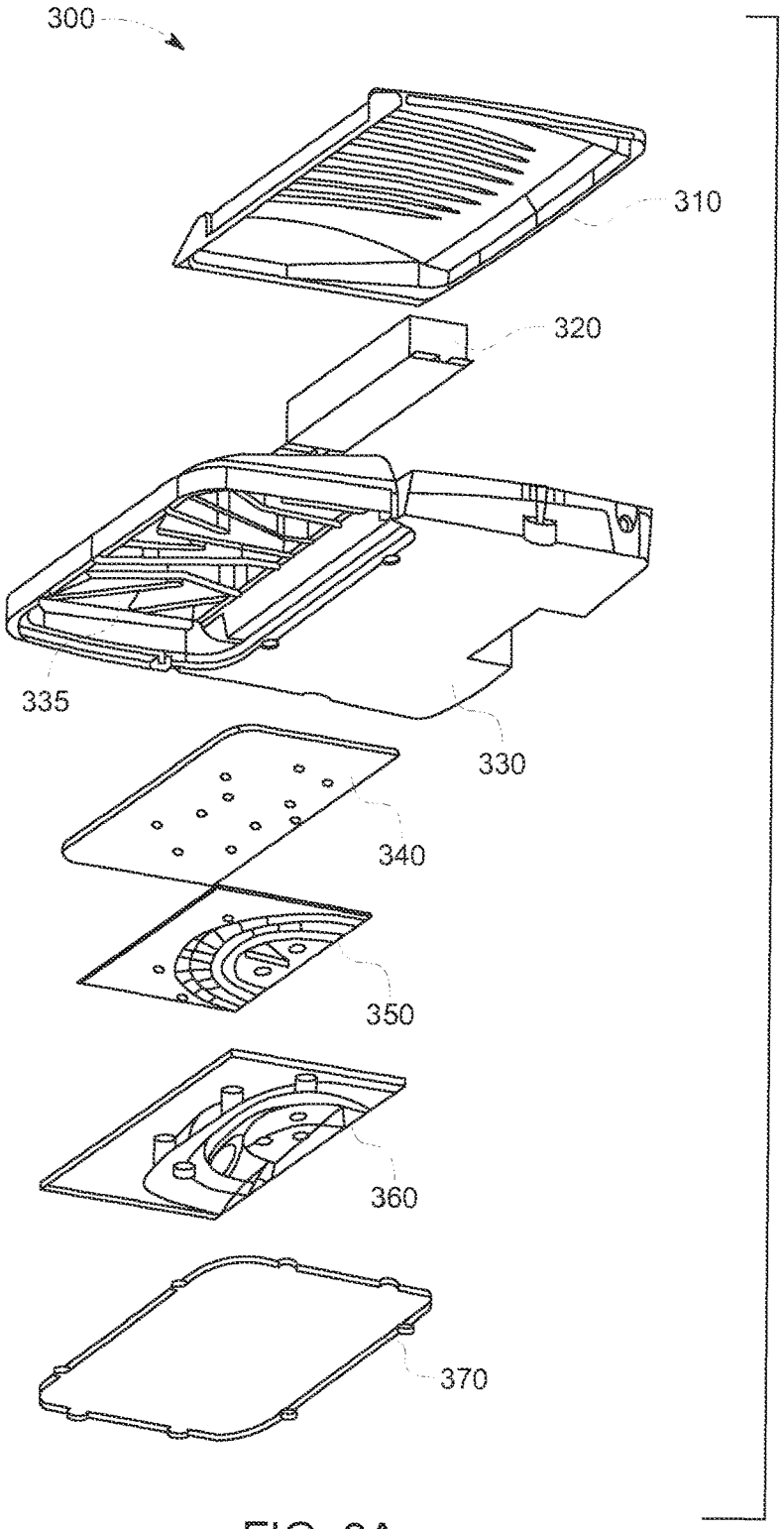
FIG. 3A depicts an exploded bottom view of an LED luminaire in accordance with some embodiments.
Figure 3B:
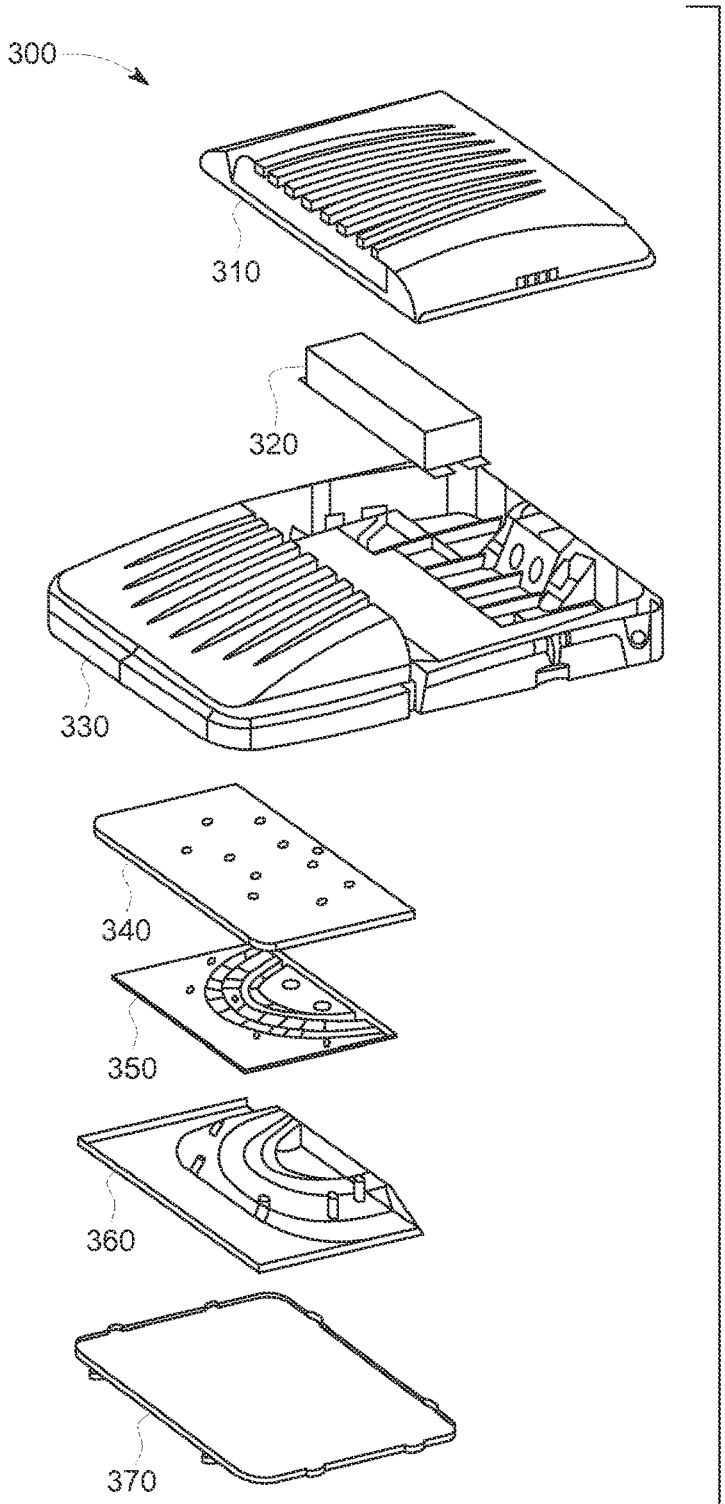
FIG. 3B depicts an exploded top view of the LED luminaire of FIG. 3A in accordance with some embodiments.

FIGS. 3A-3B depict an exploded view of LED luminaire 300 in accordance with some embodiments. FIG. 3A depicts a bottom exploded view, and FIG. 3B depicts a top exploded view of LED luminaire 300. This implementation includes driver cover (or driver door) 310 that substantially closes the internal portion of luminaire housing 330 from external air flow. The driver cover can be hinged, or removable, to permit access to an electrical compartment within the housing for maintenance of internal components. In accordance with implementations, the depicted embodiment includes aesthetic dimpling on the external surface of the housing.

Internal to the luminaire housing within the electrical compartment is LED driver electronics 320 (e.g., power supply). On an underside of the luminaire housing can be seen the ribbing of the internal inter-surface structure 335, which draws heat from heat spreader plate 340 to an external surface of luminaire housing 330. In some implementations, this ribbing can be fins or honeycombs to better laterally flow heat from the point source of the LED engine(s) mounted on LED PCB 350. This lateral heat flow reduces the peak heat intensity by increasing the surface volume that is exposed to the heat source.

The light emitted by the LED light sources can pass through optical element 360 (e.g., a diffuser, lens, etc.), which can shape the emitted light pattern. Light transmissive cover 370 can protect the optical element. This transmissive cover can be translucent, or transparent formed from any glass or plastic material.

Figure 4:
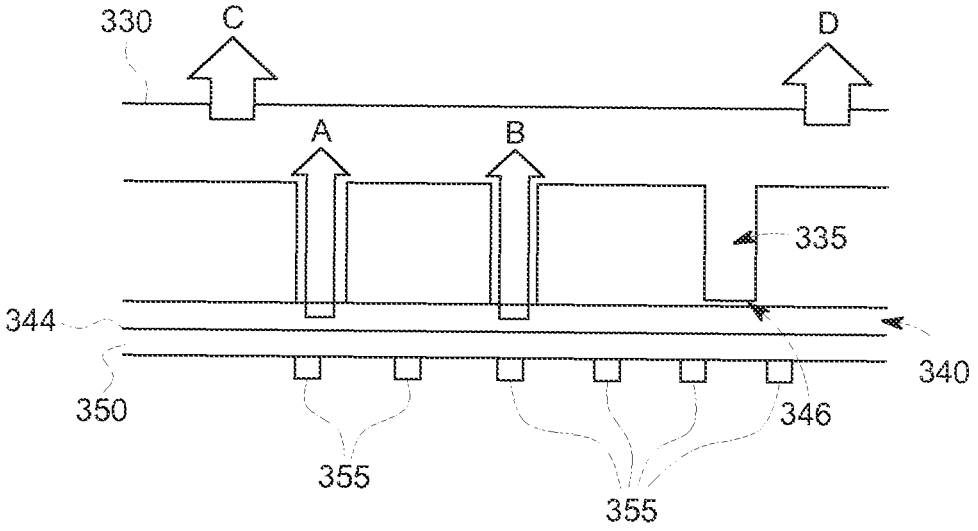
FIG. 4 depicts a thermal analysis of an LED luminaire in accordance with some embodiments.

FIG. 4 depicts a thermal analysis of an LED luminaire in accordance with some embodiments. This thermal analysis shows a cross sectional view of the luminaire. The LED light engines 355 (which are heat sources) generate a thermal point source along the LED mounting board 350. A heat spreader plate 340, formed from a thermally conductive material is in thermal, mechanical contact with the LED board along proximal surface 244 of the heat spreader plate. In some implementations the LED board and the heat spreader plate can be the same unit.

Distal surface 346 of the heat spreader plate is in contact with the internal inter-surface structure 335, which may include heatsink fins, ribbing, honeycomb, and/or the like. This internal inter-surface structure includes heat channels that flow the heat away from the LED heat point source to an interior of the luminaire's housing 330.

The heat spreader plate spreads the heat from the heat point sources laterally (perpendicular to an axis of the heat's natural flow when the luminaire is in a normal operating position), so as to reduce the heat concentration.

The shape and construction of the internal inter-surface structure can include rib channels and/or honeycomb walls that can conduct heat from the LED point source heat spots away from the MCPCB. As this heat is conducted away from the LEDs (as represented by arrows A and B), the ribbed construction and the spreader plate act to spread the heat perpendicular to an axis of the MCPCB. The internal inter-surface structure can connect the heat sources with as many surfaces in contact with the external environment as possible.

In accordance with embodiments, the housing outer surface and the light engine are thermally connected. The fins, ribbing, honeycombs, of the internal inter-surface structure are capable of spreading the heat to the external points of the housing outer surface, where the ambient air flow is the greatest. This ambient air flow draws the heat from the internal volume of the luminaire into the external environment (as represented by arrows C and D).

Figure 5:
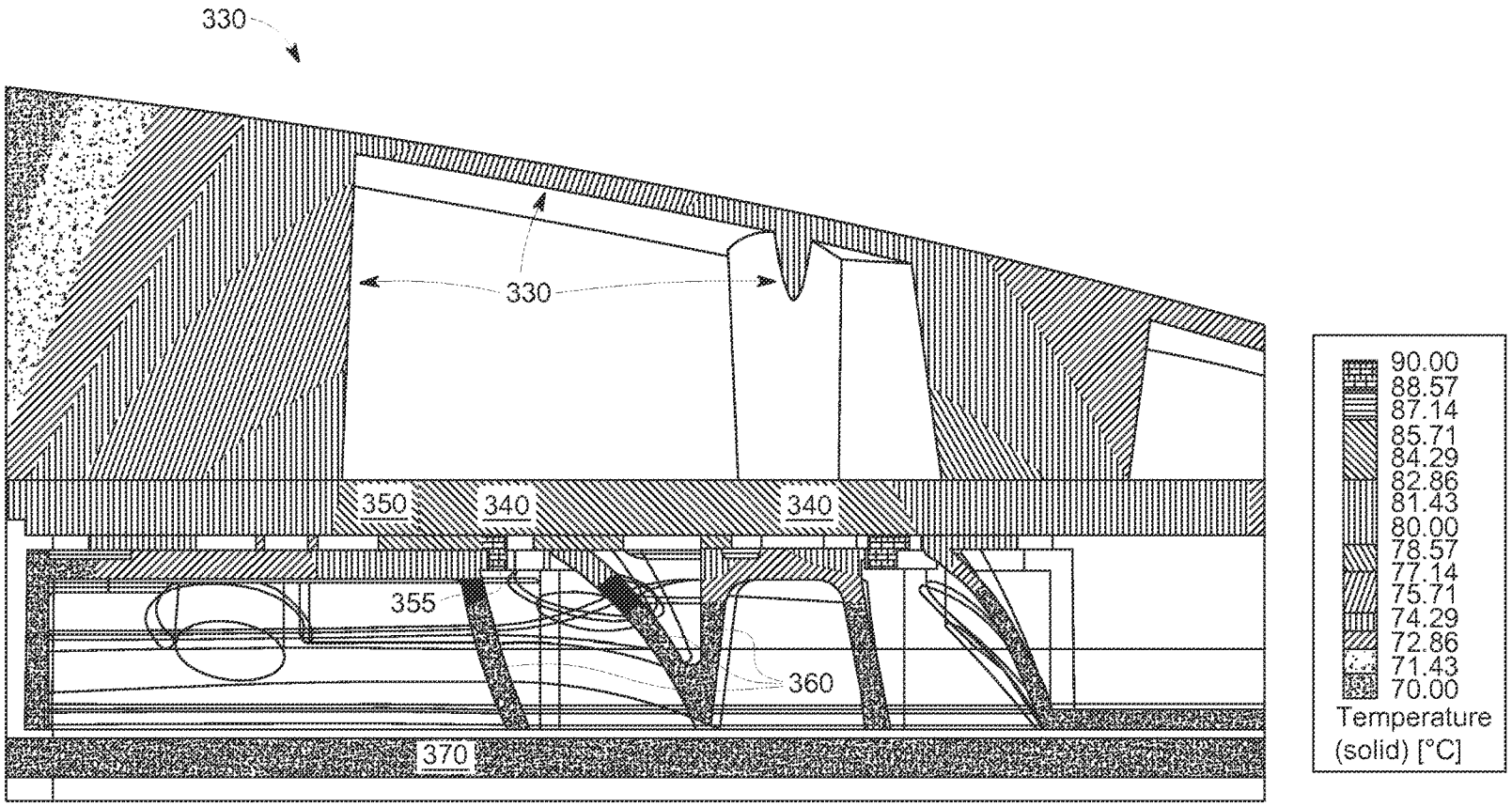
FIG. 5 depicts a thermal simulation of an LED luminaire in accordance with some embodiments.

FIG. 5 depicts a thermal simulation of an LED luminaire in accordance with some embodiments. The thermal simulation shows a cross sectional view of the LED luminaire. As described above, the concentrated heat point sources generated by the LED light sources 355 are reduced in concentration by spreading the heat laterally about an axis perpendicular to the natural heat flow. The temperature gradient between the surface of the heat spreader plate 340 in contact with the LED heat point sources and the outer surface of the luminaire housing 330 shows a lateral spreading. This lateral spreading increases the effective outer thermal interface, and reduces the operating temperature at the LED light source.

Figure 6:
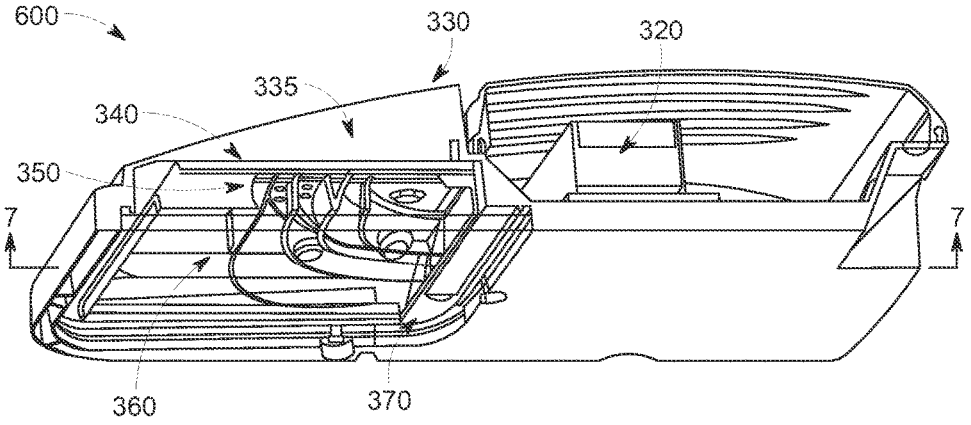
FIG. 6 depicts a bottom perspective cross section view of an LED luminaire in accordance with some embodiments.
Figure 7:
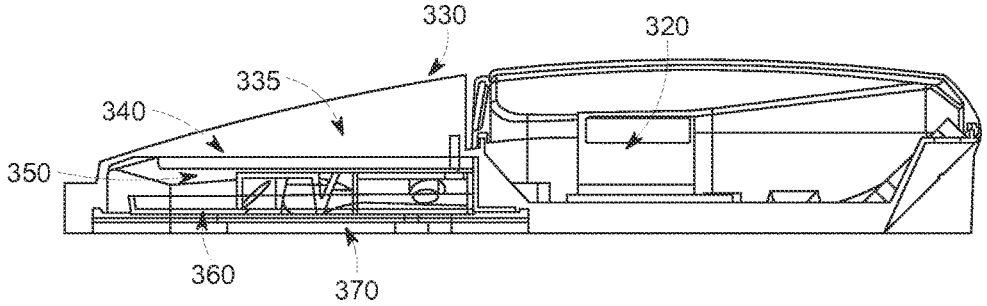
FIG. 7 depicts a cross sectional view of the LED luminaire of FIG. 6 along line 7-7 in accordance with some embodiments.

FIG. 6 depicts a bottom perspective cross section view of LED luminaire 600 in accordance with some embodiments. In accordance with embodiments, luminaire housing 330 in combination with driver cover 310 and optical element 360 (and/or, optionally, light transmissive cover 370) defines an interior volume. This interior volume contains internal inter-surface structure 335, heat spreader plate 340, LED driver electronics 320, and LED PCB 350 on which are mounted the LED light source(s). The interior volume is free of ports, exhausts, vents, and/or chimneys that are present in conventional luminaires that exchange air within the housing interior with external air. Instead, embodying luminaires include walls, fins, etc. on inter-surface structure 335 internal to the housing that spread heat generated by the LED light sources to exterior portions of the surface of the luminaire. FIG. 7 depicts a cross sectional view of the LED luminaire of FIG. 6 along line 7-7 in accordance with some embodiments.

In accordance with embodiments, the luminaire structure is substantially closed to external air flow. However the luminaire can include a door or cover hatch that makes internal ingress possible for maintenance, repair, and replacement of internal components. Embodying LED luminaires are thermally-cooled without a need for external air convection via an air port, vent, or chimney.

Although specific hardware and methods have been described herein, note that any number of other configurations may be provided in accordance with embodiments of the invention. Thus, while there have been shown, described, and pointed out fundamental novel features of the invention, it will be understood that various omissions, substitutions, and changes in the form and details of the illustrated embodiments, and in their operation, may be made by those skilled in the art without departing from the spirit and scope of the invention. Substitutions of elements from one embodiment to another are also fully intended and contemplated. The invention is defined solely with regard to the claims appended hereto, and equivalents of the recitations therein.

The invention claimed is:

1. A luminaire comprising:

a housing having an external surface and an internal surface, the housing defining an interior volume;

an LED light source within the interior volume, the LED light source mounted on a mounting surface;

an internal inter-surface structure within the interior volume in thermal communication with the mounting surface and in thermal communication with at least one housing internal surface, the internal inter-surface structure configured to spread heat generated by the LED light source laterally along the internal inter-surface structure; and the interior volume of the housing substantially closed to external air flow.

2. The luminaire of claim 1, including a heat spreader plate between the internal inter-surface structure and the LED light source.

3. The luminaire of claim 1, including the internal inter-surface structure having at least one of ribs, fins, and honeycombs.

4. The luminaire of claim 1, including the internal inter-surface structure being integral to at least one interior surface of the housing.

5. The luminaire of claim 1, the external surface of the housing being an about smooth surface free of extruding heat sink fins or ridges.

6. The luminaire of claim 2, including the heat spreader plate configured to spread heat generated by the LED light source in a lateral direction along the heat spreader plate.

7. The luminaire of claim 1, the mounting surface being one of a metal-core printed circuit board and a glass-reinforced expoxy laminate circuit board.

8. The luminaire of claim 1, the mounting surface being an integral part of the LED light source as a chip-on-board LED module.

9. The luminaire of claim 1, wherein heat generated by the LED light source is conducted to the external surface of the housing for transfer to an ambient environment.

10. The luminaire of claim 5, the about smooth surface having a shape sufficient to inhibit the trapping of water or dirt.

11. A luminaire comprising at least a housing, an LED light source, and an internal inter-surface structure, the housing including an external surface and an internal surface, the housing defining an interior volume;

the LED light source within the interior volume, the LED light source mounted on a mounting surface;

the internal inter-surface structure is within the interior volume and is in thermal communication with the mounting surface and in thermal communication with the housing internal surface, the internal inter-surface structure comprising at least one of ribs, fins, and honeycombs, the internal inter-surface structure configured to spread heat generated by the LED light source along the internal inter-surface structure; and the interior volume of the housing and the luminaire both being substantially closed to external air flow.

12. The luminaire of claim 11, further including a heat spreader plate between the internal inter-surface structure and the LED light source.

13. The luminaire of claim 11, including the internal inter-surface structure being integral to at least one interior surface of the housing.

14. The luminaire of claim 11, the external surface of the housing being an about smooth surface free of extruding heat sink fins or ridges.

15. The luminaire of claim 11, the luminaire further including a driver cover enclosing an electrical compartment, and the housing further including a light transmissive cover to transmit light from the LED light source.

16. The luminaire of claim 15, the driver cover and the light transmissive cover being a part of the housing external surface, to substantially close the internal volume to the external air flow.

17. The luminaire of claim 11, wherein heat generated by the LED light source is conducted to the external surface of the housing for transfer to an ambient environment.

18. The luminaire of claim 14, the about smooth surface having a shape sufficient to inhibit the trapping of water or dirt.

* * * * *